US008002461B2

(12) United States Patent
Kitahara et al.

(10) Patent No.: US 8,002,461 B2
(45) Date of Patent: Aug. 23, 2011

(54) WATCHBAND ATTACHING STRUCTURE AND WRISTWATCH WITH THE STRUCTURE

(75) Inventors: Masaaki Kitahara, Nishitama-gun (JP); Masato Ueno, Tama (JP)

(73) Assignee: Casio Computer Co., Ltd, Tokyo (JP)

( * ) Notice: Subject to any disclaimer, the term of this patent is extended or adjusted under 35 U.S.C. 154(b) by 0 days.

(21) Appl. No.: 12/793,928

(22) Filed: Jun. 4, 2010

(65) Prior Publication Data

US 2010/0309755 A1 Dec. 9, 2010

(30) Foreign Application Priority Data

Jun. 4, 2009 (JP) ..... 2009-134944

(51) Int. Cl.
*A44C 5/14* (2006.01)
*G04B 37/00* (2006.01)

(52) U.S. Cl. ..... 368/282; 24/265 WS; 224/180

(58) Field of Classification Search ..... 224/164–180; 368/281–283; 24/265 WS
See application file for complete search history.

(56) References Cited

U.S. PATENT DOCUMENTS 1,516,223 A * 11/1924 Wadsworth ..... 368/281
1,653,535 A * 12/1927 Bonhajo ..... 24/265 R
1,687,365 A * 10/1928 Dike ..... 24/265 WS
1,696,577 A * 12/1928 Kestenman ..... 24/265 R
2,028,791 A * 1/1936 Lynds ..... 224/174
2,032,557 A * 3/1936 Baker ..... 224/174
2,089,638 A * 8/1937 Becker ..... 24/265 WS
2,510,938 A * 6/1950 Boots ..... 24/265 B
2,713,445 A * 7/1955 Speck ..... 24/265 WS
3,585,794 A * 6/1971 Klingenberg ..... 368/281
3,889,323 A * 6/1975 Reith ..... 24/265 B
3,897,612 A * 8/1975 Bert ..... 24/265 B
4,149,662 A * 4/1979 Ramaciere ..... 224/164
4,432,476 A * 2/1984 Yokosuka ..... 224/164
5,074,069 A * 12/1991 Shire ..... 42/85
5,398,218 A * 3/1995 Munnier et al. ..... 368/282
5,951,193 A * 9/1999 Yamamoto et al. ..... 403/154
6,073,316 A * 6/2000 Ferrario et al. ..... 24/71 J
6,098,394 A * 8/2000 Hashimoto et al. ..... 59/82
6,401,307 B1 * 6/2002 Wild ..... 24/71 J
6,491,424 B1 * 12/2002 Tardy ..... 368/283
6,536,154 B1 * 3/2003 Norris ..... 42/85
7,025,496 B2 * 4/2006 Tardy ..... 368/278

(Continued)

FOREIGN PATENT DOCUMENTS

JP 11000211 1/1999

*Primary Examiner* — Sean Kayes
(74) *Attorney, Agent, or Firm* — Turocy & Watson, LLP

(57) ABSTRACT

A watchband attaching structure includes paired projections provided on a case-side end part of a watchband and having coaxial first through-holes, and an intermediate part provided at a predetermined position on an outer circumference of a wristwatch case, placed between the projections, and having a second through-hole coaxial to the first holes. A diameter of the second hole is smaller than that of the first hole. Headed first and second screw members inserted into center holes of first and second tubular members are introduced into the first holes of the projections and the second hole of the intermediate part from both sides thereof. Male threads and female threads of the distal ends of the first and second members are connected to each other in the second hole while the heads thereof with the first and second tubular members are arranged in the first holes of the projections.

16 Claims, 8 Drawing Sheets

U.S. PATENT DOCUMENTS

| | | | | |
|---|---|---|---|---|
| 7,137,733 | B2 * | 11/2006 | Suzuki | 368/316 |
| 7,210,844 | B2 * | 5/2007 | Hiranuma et al. | 368/282 |
| 7,874,047 | B2 * | 1/2011 | Breeden | 24/68 CD |
| 2002/0020726 | A1 * | 2/2002 | Gunster et al. | 224/179 |
| 2002/0040573 | A1 * | 4/2002 | Greguitch et al. | 59/80 |
| 2003/0081508 | A1 * | 5/2003 | Tardy | 368/283 |
| 2003/0116596 | A1 * | 6/2003 | Terasawa | 224/179 |
| 2005/0045677 | A1 * | 3/2005 | Yamamoto | 224/164 |

* cited by examiner

WATCHBAND ATTACHING STRUCTURE AND WRISTWATCH WITH THE STRUCTURE

CROSS-REFERENCE TO RELATED APPLICATIONS

This application is based upon and claims the benefit of priority from prior Japanese Patent Application No. 2009-134944, filed Jun. 4, 2009, the entire contents of which are incorporated herein by reference.

BACKGROUND OF THE INVENTION

1. Field of the Invention

The present invention generally relates to a watchband attaching structure and a wristwatch with the structure.

2. Description of the Related Art

One example of a conventional watchband attaching structure is described in Japanese Patent Application (KOKAI) Publication No. 11-000211. This watchband attaching structure comprises: a band attaching part which is provided at each of a pair of predetermined positions on an outer circumferential surface of a wristwatch case, and which includes a pair of projections having attaching holes formed coaxially with each other; a watchband which includes a case-side end part placed between the projections of the band attaching part and having a through-hole arranged coaxially with the attaching holes of the projections; one connection pipe which has both end parts, each being provided with female threads on its inner circumferential surface, and which is inserted into the attaching holes of the projections of the band attaching part and the through-hole of the case-side end part of the watchband; and a headed fixing screw member which is screwed into the female threads on the inner circumferential surface of each of the both end parts of the connection pipe, on an outside surface of each of the projections of the band attaching part.

In this conventional watchband attaching structure, when an external force is applied to the case-side end part of the watchband to rock the case-side end part of the watchband on the connection pipe relative to the projections of the band attaching part, a very small rocking of the case-side end part of the watchband causes the screw members to rotate very small relative to the both end parts of the connection pipe. If such a relative rocking continues for a long period of time, the screwing of the screw members to the both end parts of the connection pipe may by loosened.

This invention is derived under the above described circumstance, and an object of this invention is to provide a watchband attaching structure which surely keeps an attaching of a case-side end part of a watchband to a predetermined position on an outer circumferential surface of a wristwatch case, for a long period of time by a simple structure, and a wristwatch having the watchband attaching structure.

BRIEF SUMMARY OF THE INVENTION

According to an aspect of the present invention, a watchband attaching structure for attaching a case-side end part of a watchband to a predetermined position on an outer circumferential surface of a wristwatch case, comprises: a pair of projections which is provided at one of the predetermined position on the outer circumferential surface of the wristwatch case and the case-side end part of the watchband, and each of which includes a first through-hole, the first through-holes having the same diameter as to each other and arranged coaxially with each other; and an intermediate part which is provided at the other of the predetermined position on the outer circumferential surface of the wristwatch case and the case-side end part of the watchband, which is placed between the projections, and which includes a second through-hole arranged coaxially to the first through-holes of the projections and having a diameter being smaller than the diameter of the first through-hole.

The watchband attaching structure further comprises: a first screw member which includes a head, a shaft fixed coaxially with the head and having an outer circumferential surface and a distal end part being opposite to the head, and male threads formed on the distal end part of the outer circumferential surface, the head having a diameter being smaller than the diameter of the first through-hole and being larger than the diameter of the second through-hole, and the outer circumferential surface of the shaft having a diameter being smaller than the diameter of the second through-hole; a first tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the first screw member; a second screw member which includes a head, a shaft fixed coaxially with the head and having an outer circumferential surface and a distal end part being opposite to the head, and female threads formed in the distal end part of shaft, the head having a diameter being smaller than the diameter of the first through-hole and being larger than the diameter of the second through-hole, and the outer circumferential surface of the shaft having a diameter being smaller than the diameter of the second through-hole; and a second tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the second screw member.

The shaft of the first screw member is inserted into the center hole of the first tubular member, and then is inserted into the first through hole of one of the projections from an outside of the first through-hole of the one projection, and finally is inserted into the second through-hole of the intermediate part. And, the shaft of the second screw member is inserted into the center hole of the second tubular member, and then is inserted into the first through hole of the other projection from an outside of the first through-hole of the other projection, and then is inserted into the second through-hole of the intermediate part, and finally the male threads of the distal end part on the shaft of the first screw member are screwed into the female threads in the distal end part of the second screw member.

In this state, the first tubular member on the shaft of the first screw member in the first through-hole of the one projection is placed between the head of the first screw member and a side surface of the intermediate member located near to the one projection, and the second tubular member on the shaft of the second screw member in the first through-hole of the other projection is placed between the head of the second screw member and a side surface of the intermediate member located near to the other projection.

According to an aspect of the present invention, a wristwatch comprises: a wristwatch case which includes an outer circumferential surface and which contains a time measuring unit configured to measure a time, and a time display unit configured to display the time measured by the time measuring unit; a watchband which has a case-side end part located near to the wristwatch case; and a watchband attaching structure which is configured to attach the case-side end part of the watchband to a predetermined position on the outer circumferential surface of the wristwatch case.

The watchband attaching structure comprises: a pair of projections which is provided at one of the predetermined position on the outer circumferential surface of the wristwatch case and the case-side end part of the watchband, and each of which includes a first through-hole, the first through-holes of the projections having the same diameter as to each other and arranged coaxially with each other; and an intermediate part which is provided at the other of the predetermined position on the outer circumferential surface of the wristwatch case and the case-side end part of the watchband, which is placed between the projections, and which includes a second through-hole arranged coaxially to the first through-holes of the projections and having a diameter being smaller than the diameter of the first through-hole.

The watchband attaching structure further comprises: a first screw member which includes a head, a shaft fixed coaxially with the head and having an outer circumferential surface and a distal end part being opposite to the head, and male threads formed on the distal end part of the outer circumferential surface, the head having a diameter being smaller than the diameter of the first through-hole and being larger than the diameter of the second through-hole, and the outer circumferential surface of the shaft having a diameter being smaller than the diameter of the second through-hole; a first tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the first screw member; a second screw member which includes a head, a shaft fixed coaxially with the head and having an outer circumferential surface and a distal end part being opposite to the head, and female threads formed in the distal end part of shaft, the head having a diameter being smaller than the diameter of the first through-hole and being larger than the diameter of the second through-hole, and the outer circumferential surface of the shaft having a diameter being smaller than the diameter of the second through-hole; and a second tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the second screw member.

The shaft of the first screw member is inserted into the center hole of the first tubular member, and then is inserted into the first through hole of one of the projections from an outside of the first through-hole of the one projection, and finally is inserted into the second through-hole of the intermediate part. And, the shaft of the second screw member is inserted into the center hole of the second tubular member, and then is inserted into the first through hole of the other projection from an outside of the first through-hole of the other projection, and then is inserted into the second through-hole of the intermediate part, and finally the male threads of the distal end part on the shaft of the first screw member are screwed into the female threads in the distal end part of the second screw member.

In this state, the first tubular member on the shaft of the first screw member in the first through-hole of the one projection is placed between the head of the first screw member and a side surface of the intermediate member located near to the one projection, and the second tubular member on the shaft of the second screw member in the first through-hole of the other projection is placed between the head of the second screw member and a side surface of the intermediate member located near to the other projection.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out herein after.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

First, a wristwatch 10 provided with a first embodiment of a watchband attaching structure according to the present invention and a watchband attaching structure 12 according to the first embodiment will be explained with reference to FIGS. 1 to 3.

Figure 1:
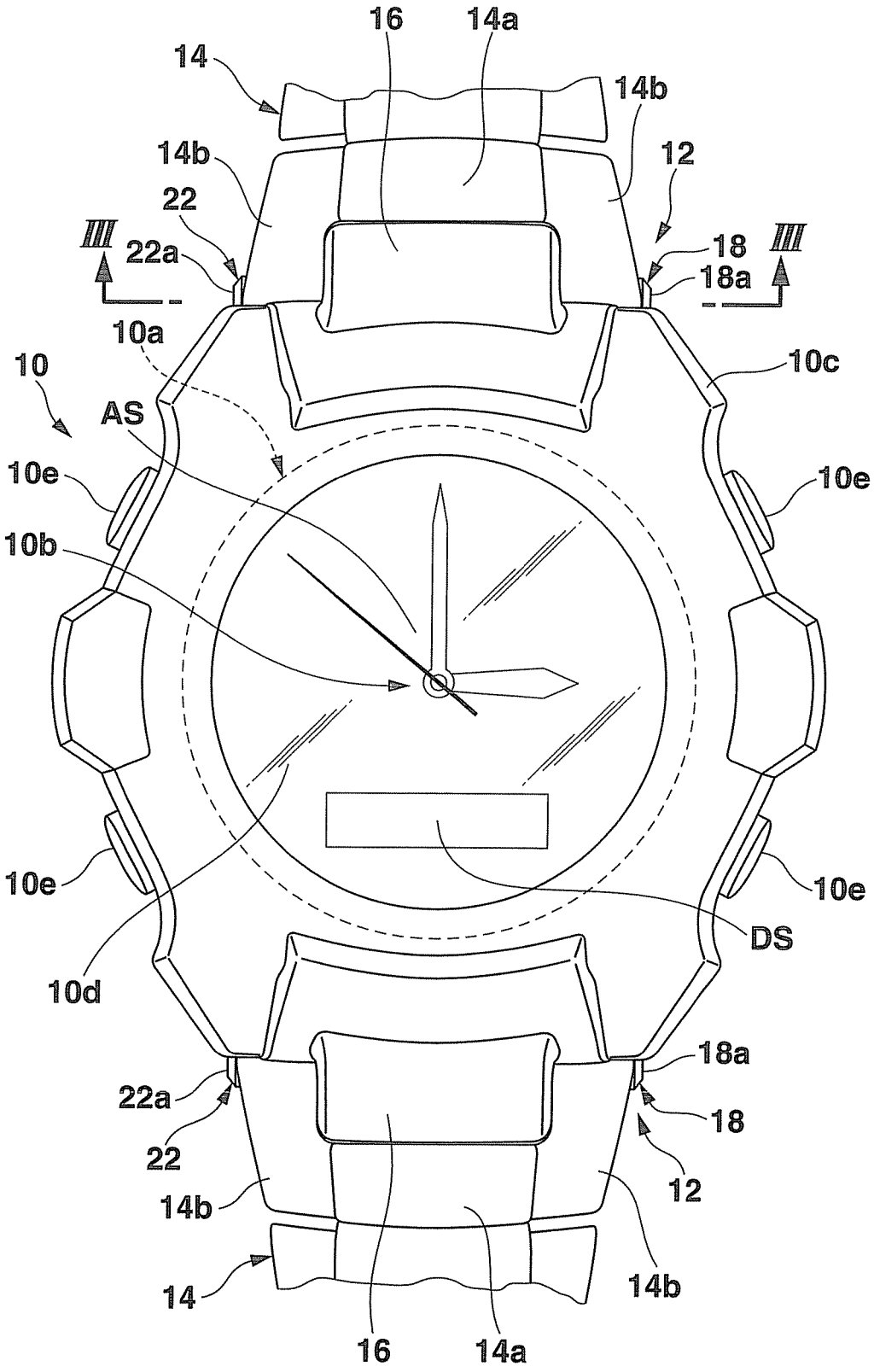
FIG. 1 is an enlarged plan view schematically showing an essential part of a wristwatch having a first embodiment of a watchband attaching structure according to the present invention.

As shown in FIG. 1, the wristwatch 10 comprises a wristwatch case 10*c* which contains a known time measuring unit 10*a* measuring time and a known time display unit 10*b* displaying time measured by the time measuring unit 10*a*.

The known time measuring unit 10*a* can be a mechanical time measuring unit, a driving source of which is a spiral hairspring wound manually through a not shown crown provided on an outer circumferential surface of the wristwatch case 10*c* or wound by using an oscillation of an oscillating weight provided in the wristwatch case 10*c*, or can be an electrical time measuring unit using a battery as a driving source loaded in the wristwatch case 10*c*. In addition to the battery, the electrical time measuring unit can further use a solar panel which is loaded in an inside of a light transmissible decoration or dial plate located under a watch glass 10*d* provided on a front side surface of the wristwatch case 10*c*.

The known time display unit 10*b* can be an analog type AS including at least one of a second hand, a minute hand, and an hour hand, or can be a digital type DS using an image display such as a liquid crystal display. The known time display unit 10*b* can use those of both of the analog type AS and the digital type DS.

A plurality of push button switches 10*e* for controlling the known time measuring unit 10*a* and time display unit 10*b* is provided on the outer circumferential surface of the wristwatch case 10*c*. In the wristwatch case 10*c*, known electronic circuits driven by the above-described battery to perform known various functions can be contained. In this case, the push button switches 10*e* can be used as push button switches for controlling the known electronic circuits.

Further, it is possible to make the image display of the digital type DS display operating states of the electronic circuits. Further, any pointing device for displaying the states of the electronic circuits can be provided on the decoration or dial plate located inside the watch glass 10*d*.

In this embodiment, the watchband attaching structure 12 is provided at each of two predetermined positions on the outer circumferential surface of the wristwatch case 10*c*, the two predetermined positions being apart from each other at an angle of 180 degrees. These watchband attaching structures 12 have the same configuration as to each other. Each watchband attaching structure 12 is configured to attach a case-side end part 14*a* of the watchband 14 at each of the two predetermined positions on the outer circumferential surface of the wristwatch case 10*c*.

Figure 2:
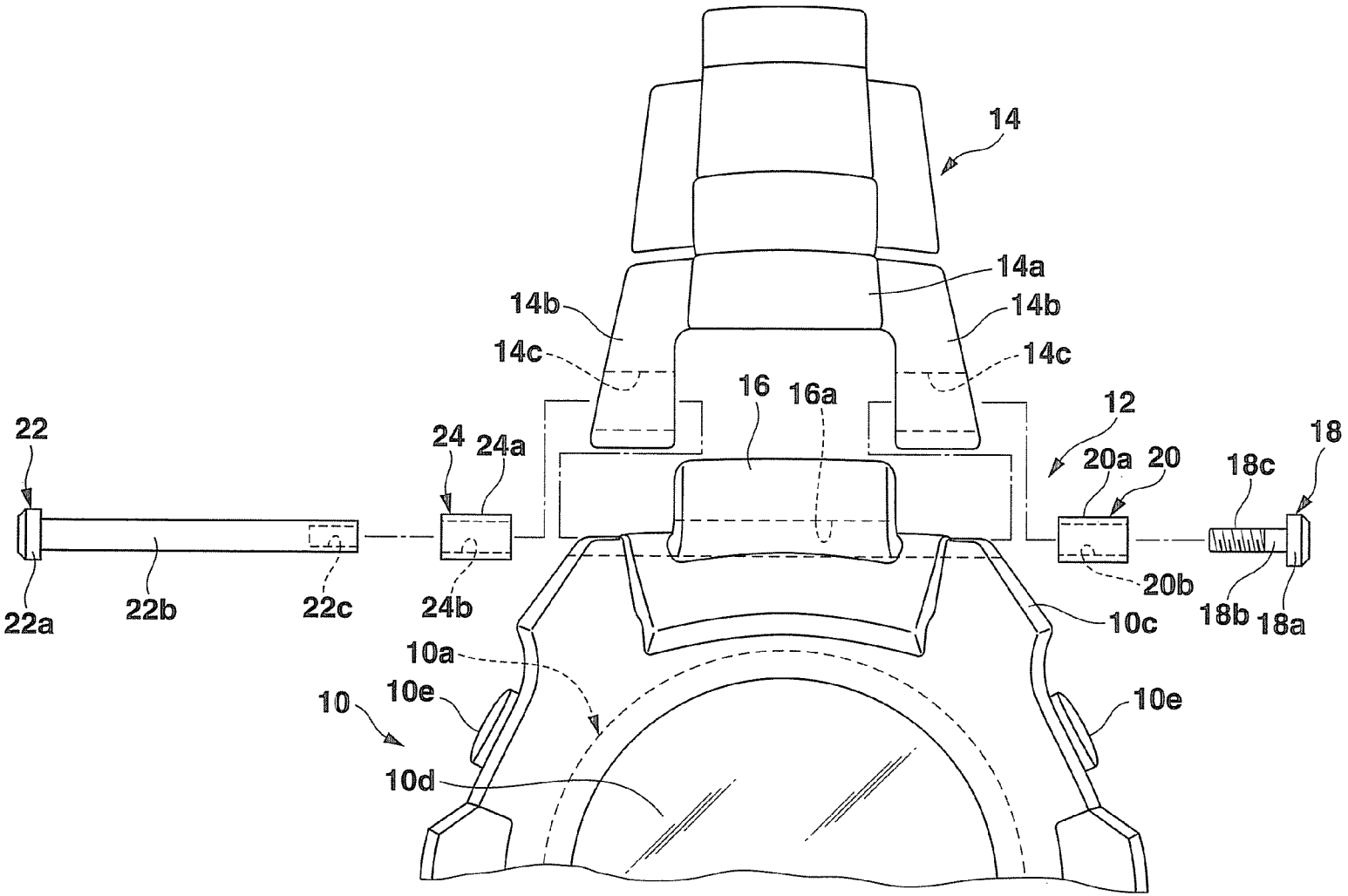
FIG. 2 is a schematically exploded plane view of the watchband attaching structure according to the first embodiment shown in FIG. 1.
Figure 3:
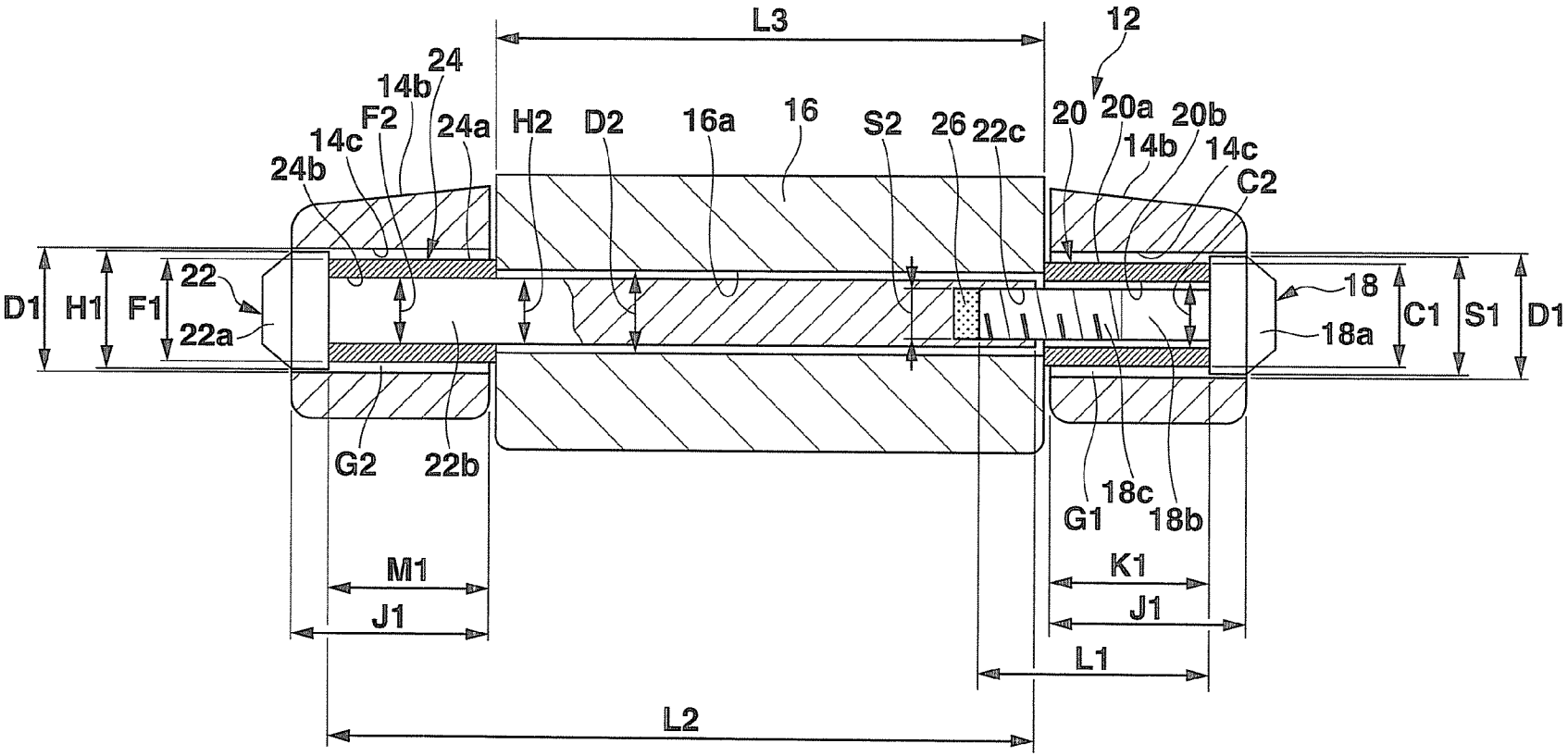
FIG. 3 is a schematically sectional view of the watchband attaching structure according to the first embodiment taken along a line III-III in FIG. 1.

As shown in detail in FIGS. 2 and 3, each watchband attaching structure 12 includes a pair of projections 14*b* provided on the case-side end part 14*a* of the watchband 14. A first through-hole 14*c* is formed in each projection 14*b*. These first through-holes 14*c* are arranged coaxially with each other, and have the same diameter D1.

Each watchband attaching structure 12 includes an intermediate part 16 provided at each of the two predetermined positions on the outer circumferential surface of the wristwatch case 10*c*, the two predetermined positions being apart from each other at an angle of 180 degrees. And, the intermediate part 16 is placed between the projections 14*b* provided on the case-side end part 14*a* of the watchband 14. A second through-hole 16*a* is formed in the intermediate part 16. When the intermediate part 16 is placed between the projections 14*b*, the second through-hole 16*a* is arranged coaxially to the first through-holes 14*c* of these projections 14*b*. A diameter D2 of the second through-hole 16*a* is smaller than a diameter D1 of the first through-hole 14*c*.

Each watchband attaching structure 12 comprises a first screw member 18 including a head 18*a*, a shaft 18*b* arranged coaxially to the head 18*a*, and male threads 18*c* formed on a distal end part of an outer circumferential surface of the shaft 18*b*. A diameter S1 of the head 18*a* is smaller than the diameter D1 of the first through-hole 14*c* of each of the projections 14*b* on the case-side end part 14*a* of the watchband 14, and is larger than the diameter D2 of the second through-hole 16*a* of the intermediate part 16 of the wristwatch case 10*c*. A diameter S2 of the shaft 18*b* is smaller than the diameter S1 of the head 18*a*, and is smaller than the diameter D2 of the second through-hole 16*a*.

Each watchband attaching structure 12 comprises a first tubular member 20. The first tubular member 20 includes an outer circumferential surface 20*a* and a center hole 20*b*. The outer circumferential surface 20*a* has an outer diameter C1 which is smaller than the diameter D1 of the first through-hole 14*c* and which is larger than the diameter D2 of the second through-hole 16*a*. The center hole 20*b* is defined by an inner circumferential surface having an inner diameter C2 which is larger than the diameter S2 of the shaft 18*b* of the first screw member 18.

Each watchband attaching structure 12 comprises a second screw member including a head 22*a*, a shaft 22*b* being arranged coaxially to the head 22*a*, and female threads 22*c* formed in a distal end part of the shaft 22*b*. A diameter H1 of the head 22*a* is smaller than the diameter D1 of the first through-hole 14*c*, and is larger than the diameter D2 of the second through-hole 16*a*. A diameter H2 of the shaft 22*b* is smaller than the diameter H1 of the head 22*a*, and is smaller than the diameter D2 of the second through-hole 16*a*.

Each watchband attaching structure 12 further comprises a second tubular member 24. The second tubular member 24 has an outer circumferential surface 24*a* and a center hole 24*b*. The outer circumferential surface 24*a* has an outer diameter F1 which is smaller than the diameter D1 of the first through-hole 14*d* and which is larger than the diameter D2 of the second through-hole 16*a*. The center hole 24*b* is defined by an inner circumferential surface which has an inner diameter F2 being larger than the diameter H2 of the shaft 22*b* of the second screw member 22.

As shown well in FIG. 2, the shaft 18*b* of the first screw member 18 is inserted into the center hole 20*b* of the first tubular member 20, and then is inserted into the first through-hole 14*c* of one of the projections 14*b* (the right side one in FIG. 2) on the case-side end part 14*a* of the watchband 14 from an outside of the one projection 14*b*, and is finally inserted into the second through-hole 16*a* of the intermediate part 16 on the outer circumferential surface of the wristwatch case 10*c*.

As shown well in FIG. 2, the shaft 22*b* of the second screw member 22 is inserted into the center hole 24*b* of the second tubular member 24, and then is inserted into the first through-hole 14*c* of the other of the projections 14*b* (the left side one in FIG. 2) on the case-side end part 14*a* of the watchband 14 from an outside of the other projection 14*b*, and is finally inserted into the second through-hole 16*a* of the intermediate part 16 on the outer circumferential surface of the wristwatch case 10*c*. As shown in FIG. 3, the male threads 18*c* on the distal end part of the shaft 18*b* of the first screw member 18 are screwed into the female threads 22*c* in the distal end part of the shaft 22*b* of the second screw member 22.

An adhesive 26 is applied to the female threads 22*c* in the distal end part of the shaft 22*b* of the second screw member 22. The male threads 18*c* on the distal end part of the shaft 18*b* of the first screw member 18, screwed into the female threads 22*c* in the distal end part of the shaft 22*b* of the second screw member 22, are fixed to the female threads 22*c* by the adhesive 26.

As a result, as shown well in FIG. 3, the first tubular member 20 on the shaft 18*b* of the first screw member 18 is introduced into the first through-hole 14*c* of the one projection 14*b* (the right side one in FIG. 3), and is placed between the head 18*a* of the first screw member 18 and one side surface of the intermediate member 16, the one side surface being located near to the one projection 14*b*. At the same time, the second tubular member 22 on the shaft 22*b* of the second screw member 22 is introduced into the first through-hole 14*c* of the other projection 14*b* (the left side one in FIG. 3), and is placed between the head 22*a* of the second screw member 22 and another side surface of the intermediate member 16, the other side surface being located near to the other projection 14*b*.

In this embodiment, the outer diameter C1 of the outer circumferential surface 20*a* of the first tubular member 20 is smaller than the outer diameter S1 of the head 18*a* of the first screw member 18, and the outer diameter F1 of the outer circumferential surface 24*a* of the second tubular member 24 is smaller than the outer diameter H1 of the head 22*a* of the second screw member 22. As a result, a relatively large clearance G1 is produced between the outer circumferential surface 20*a* of the first tubular member 20 and the inner circumferential surface of the first through-hole 14*c* of the one projection 14*b*, and a relatively large clearance G2 is produced between the outer circumferential surface 24*a* of the second tubular member 24 and the inner circumferential surface of the first through-hole 14*c* of the other projection 14*b*. The outer diameter C1 of the outer circumferential surface 20*a* and the diameter C2 of the center hole 20*b* in the first tubular member 20 are the same as the outer diameter F1 of the outer circumferential surface 24*a* and the diameter F2 of the center hole 24*b* in the second tubular member 24. Therefore, the above described clearances S1 and S2 are the same. However, in accordance with an aspect of the present invention, the outer diameter C1 of the outer circumferential surface 20*a* and the diameter C2 of the center hole 20*b* in the first tubular member 20 may not be the same as the outer diameter F1 of the outer circumferential surface 24*a* and the diameter F2 of the center hole 24*b* in the second tubular member 24.

In this embodiment, a length K1 of the first tubular member 20 in a direction along a center line of the center hole 20*b* of the first tubular member 20 is shorter than a length J1 of the first through-hole 14*c* in a direction along a center line of the first through-hole 14*c* of the one projection 14*b*, and a length M1 of the second tubular member 24 in a direction along a center line of the center hole 24*b* of the second tubular member 24 is shorter than the length J1 of the first through-hole 14*c* in a direction along a center line of the first through-hole 14*c* of the other projection 14*b*. The length K1 of the first tubular member 20 is the same as the length M1 of the second tubular member 24. However, in accordance with the aspect of the present invention, the length K1 of the first tubular member 20 may not be the same as the length M1 of the second tubular member 24.

In this embodiment, a length L1 of the shaft 18*b* of the first screw member 18 in a direction along a longitudinal center line of the first screw member 18 is shorter than a length L2 of the shaft 22*b* of the second screw member 22 in a direction along a longitudinal center line of the second screw member 22, and the distal end part of the shaft 22*b* of the second screw member 22 is located between a center of the second through-hole 16*a* in a direction along a center line of the second through-hole 16*a* and an end of the second through-hole 16*a* located close to the one projection 14*b*, in the second through-hole 16*a* of the intermediate member 16.

That is, the length L1 of the shaft 18*b* of the first screw member 18 is longer than the length K1 of the first tubular member 20, but is shorter than the total of the length K1 of the first tubular member 20 and the half of the length L3 of the second through-hole 16*a* in the direction along the center line of the second through-hole 16*a*. Further, the length L2 of the shaft 22*b* of the second screw member 22 is longer than the total of the length M1 of the second tubular member 24 and the half of the length L3 of the second through-hole 16*a* in the direction along the center line of the second through-hole 16*a*, but is shorter than the total of the length M1 of the second tubular member 24 and the length L3 of the second through-hole 16*a* in the direction along the center line of the second through hole 16*a*.

FIG. 3 shows that the shaft 18*b* of the first screw member 18, on which the first tubular member 20 is fit, and the shaft 22*b* of the second screw member 22, on which the second tubular member 24 is fit, are inserted into the first through-holes 14*c* of the two projections 14*b* on the case-side end part 14*a* of the watchband 14, and then, in the second through-hole 16*a* of the intermediate part 16 on the outer circumferential surface of the wristwatch case 10*c*, the male threads 18*c* on the distal end part of the shaft 18*b* of the first screw member 18 are screwed into the female threads 22*c* in the distal end part of the shaft 22*b* of the second screw member 22, and finally the male threads 18*c* on the distal end part of the shaft 18*b* of the first screw member 18 are fixed with the female threads 22*c* in the distal end part of the shaft 22*b* of the second screw member 22 by the adhesive 26. In this state, the heads 18*a* and 22*a* of the first and second screw members 18 and 22 are partially projected out from outsides of the first through-holes 14*c* of the two projections 14*b*, the outsides being located opposite to the intermediate part 16. However, the whole of each of the heads 18*a* and 22*a* of the first and second screw members 18 and 22 may be placed inward from each of the outsides of the first through-holes 14*c* of the two projections 14*b*.

In this embodiment, as shown in FIG. 3, the first and second screw members 18 and 22, which are inserted into the first through-holes 14*c* of the two projections 14*b* on the case-side end part 14*a* of the watchband 14 and the second through-hole 16*a* of the intermediate part 16 on the outer circumferential surface of the wristwatch case 10*c*, are screwed with and fixed with each other at their distal end parts, as described above. And, the first and second tubular members 20 and 24 on the shafts 18*b* and 22*b* of the first and second screw members 18 and 22 are pressed by the heads 18*a* and 22*a* of the first and second screw members 18 and 22, and are in contact with the outside surfaces of the intermediate part 16. In this state, the first and second screw members 18 and 22 are so positioned that each of outer circumferential surfaces of their heads 18*a* and 22*a* partially or wholly contacts the inner circumferential surface of the first through-hole 14*c* of the projection 14*b*, by the first and second tubular members 20 and 24.

Therefore, while the projections 14*b* on the case-side end part 14*a* of the watchband 14 rocks on the shafts 18*b* and 22*b* of the first and second screw members 18 and 22 to the intermediate part 16 on the outer circumferential surface of the wristwatch case 10*c*, a large friction force is not generated between the outer circumferential surface of the head 18*a* of the first screw member 18 and the inner circumferential surface of the first through-hole 14*c* of the one projection 14*b*, and also a large friction force is not generated between the outer circumferential surface of the head 22*a* of the second screw member 22 and the inner circumferential surface of the first through-hole 14*c* of the other projection 14*b*. As a result, the screw connection between the distal end parts of the first and second screw members 18 and 22 will not loosen by the above described rocking, further the adhesive 26 fixing the distal end parts to each other surely prevent the loose of the screw connection.

Second Embodiment

Next, the wristwatch 10 provided with a second embodiment of the watchband attaching structure according to the present invention, and a watchband attaching structure 12' of the second embodiment will be explained with reference to FIG. 4.

The most component members of the watchband attaching structure 12' of the second embodiment are the same as those of the watchband attaching structure 12 of the first embodiment explained with reference to FIGS. 1 to 3. Therefore, the component members of the watchband attaching structure 12' of the second embodiment, which are the same as those of the watchband attaching structure 12 of the first embodiment, are denoted by the same reference numerals as those denoting the same component members of the watchband attaching structure 12 of the first embodiment corresponding thereto, and detailed explanations thereof are omitted.

The watchband attaching structure 12' of the second embodiment is different from the watchband attaching structure 12 of the first embodiment in a diameter C'1 of an outer circumferential surface 20'*a* of a first tubular member 20', and in a diameter F'1 of an outer circumferential surface 24'*a* of a second tubular member 24'.

The diameter C'1 of the outer circumferential surface 20'*a* of the first tubular member 20' of the second embodiment is larger than the outer diameter S1 of the head 18*a* of the first screw member 18, and is smaller than the diameter D1 of the first through-hole 14*c* of the one projection 14*b* corresponding to the first tubular member 20'. The diameter F'1 of the outer circumferential surface 24'*a* of the second tubular member 24' of the second embodiment is larger than the outer diameter H1 of the head 22*a* of the second screw member 22, and is smaller than the diameter D1 of the first through-hole 14*c* of the other projection 14*b* corresponding to the second tubular member 24'.

Figure 4:
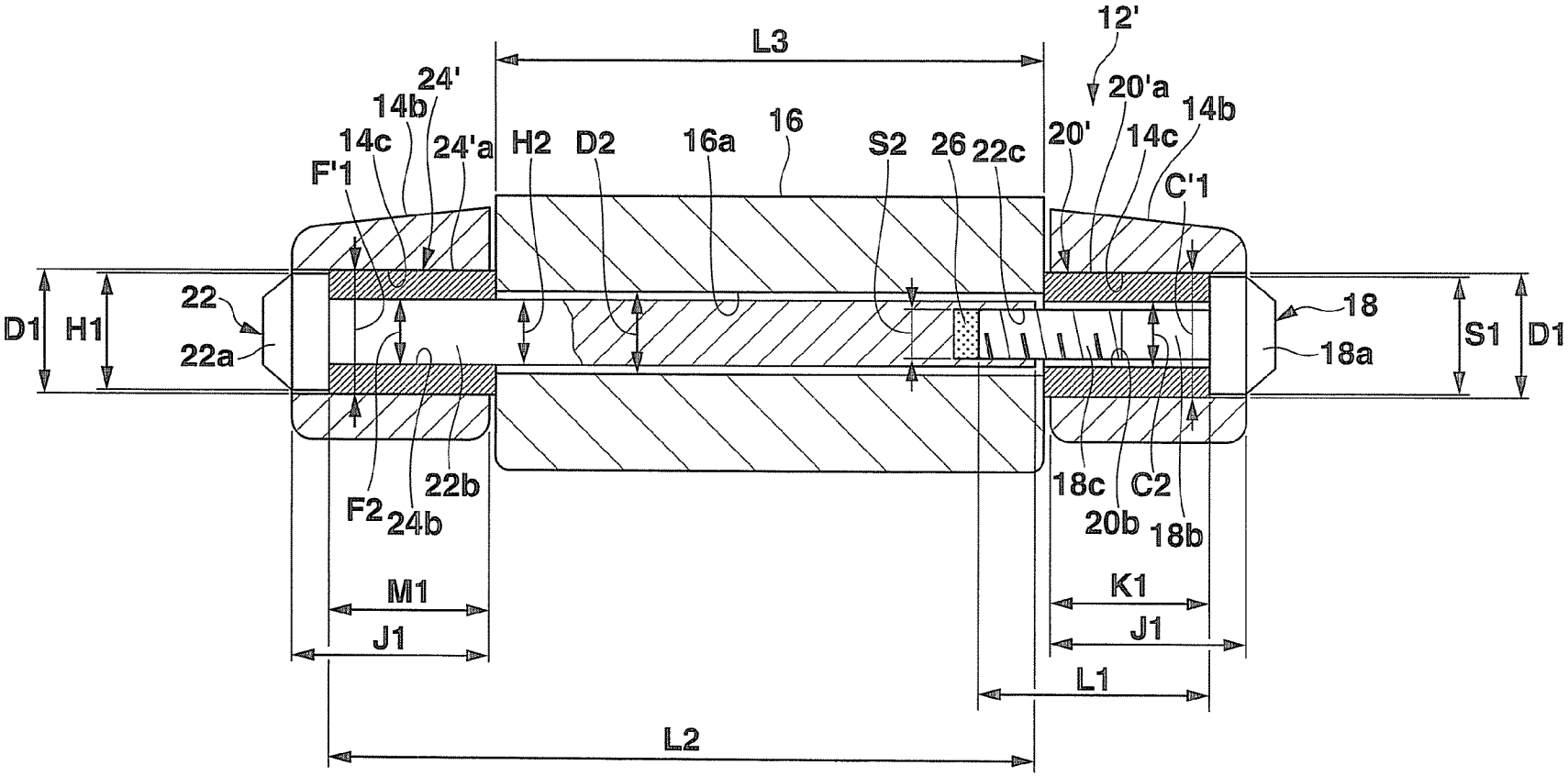
FIG. 4 is a schematically sectional view of a wristwatch having a second embodiment of the watchband attaching structure according to the present invention, and is similar to FIG. 3.

In this embodiment, as shown in FIG. 4, while the first and second screw members 18 and 22 are inserted into the first through-holes 14*c* of the paired projections 14*b* on the case-end part 14*a* of the watchband 14 shown in FIGS. 1 and 2 and the second through-hole 16*a* of the intermediate part 16 on the outer circumferential surface of the wristwatch case 10*c* shown in FIGS. 1 and 2, the distal end parts of the first and second screw members 18 and 22 are screwed with and fixed with each other in the second through-hole 16*a* of the intermediate part 16 on the outer circumferential surface of the wristwatch case 10*c*, as described hereinbefore. In this state, the first and second tubular members 20' and 24', which are supported on the shafts 18*b* and 22*b* of the first and second screw members 18 and 22 and which are made in contact with the both outside surfaces of the intermediate part 16 by the heads 18*a* and 22*a* of the first and second screw members 18 and 22 in the first through-holes 14*c* of the projections 14, make their outer circumferential surfaces 20'*a* and 24'*a* be in contact with the inner circumferential surfaces of the first through-holes 14*c* of the projections 14*b* corresponding thereto and prevent the outer circumferential surfaces of the heads 18*a* and 22*a* from being in contact with the inner circumferential surfaces of the first through-holes 14*c* of the projections 14*b* corresponding thereto.

The first tubular member 20' is freely rotational on the shaft 18*b* of the first screw member 18 without generating a large frictional force on at least one of the inner circumferential surface of the first through-hole 14*c* of the one projection 14*b* corresponding thereto and the outer circumferential surface of the shaft 18*b* of the first screw member 18. The second tubular member 24' is freely rotational on the shaft 22*b* of the second screw member 22 without generating a large frictional force on at least one of the inner circumferential surface of the first through-hole 14*c* of the other projection 14*b* corresponding thereto and the outer circumferential surface of the shaft 22*b* of the second screw member 22.

Therefore, even if the projections 14*b* on the case-side end part 14*a* of the watchband 14 shown in FIGS. 1 and 2 rock on the shafts 18*b* and 22*b* of the first and second screw members 18 and 22 with respect to the intermediate part 16 on the outer circumferential surface of the wristwatch case 10*c* shown in FIGS. 1 and 2, a large frictional force is not generated between the outer circumferential surface of the head 18*a* of the first screw member 18 and the inner circumferential surface of the first through-hole 14*c* of the one projection 14*b* corresponding thereto, and between the outer circumferential surface of the head 22*a* of the second screw member 22 and the inner circumferential surface of the first through-hole 14*c* of the other projection 14*b* corresponding thereto. As a result of this, the screwing between the distal end parts of the first and second screw members 18 and 22 is not loosen by the above rocking, and the adhesive 26 fixing the distal end parts surely prevents the screwing between the distal end parts of the first and second screw members 18 and 22 from loosing.

Third Embodiment

Next, a wristwatch 10' provided with a third embodiment of the watchband attaching structure according to the present invention, and a watchband attaching structure 30 of the third embodiment will be explained with reference to FIGS. 5 to 7.

The most component members of the watchband attaching structure 30 of the third embodiment are the same as those of the watchband attaching structure 12 of the first embodiment explained with reference to FIGS. 1 to 3. Therefore, the component members of the watchband attaching structure 30 of the third embodiment, which are the same as those of the watchband attaching structure 12 of the first embodiment, are denoted by the same reference numerals as those denoting the same component members of the watchband attaching structure 12 of the first embodiment corresponding thereto, and detailed explanations thereof are omitted.

The watchband attaching structure 30 of the third embodiment is different from the watchband attaching structure 12 of the first embodiment in that a pair of projections 32 is provided at each of two predetermined positions on the outer circumferential surface of the wristwatch case 10*c*, the two positions being apart from each other at an angle of 180 degrees, and further that an intermediate part 34, which is placed between the paired projections 32 at each of the two predetermined positions on the outer circumferential surface of the wristwatch case 10*c*, is provided on the case-side end part 14*a* of the watchband 14.

A first through-hole 32*a* is formed in each projection 32. These first through-holes 32*a* are arranged coaxially with each other, and have the same diameter D1. A second through-hole 34*a* is formed in the intermediate part 34. When the intermediate part 34 is placed between the projections 32, the second through-hole 34*a* is arranged coaxially to the first through-holes 32*a* of these projections 32. A diameter D2 of the second through-hole 34*a* is smaller than a diameter D1 of the first through-hole 32*a*.

Figure 7:
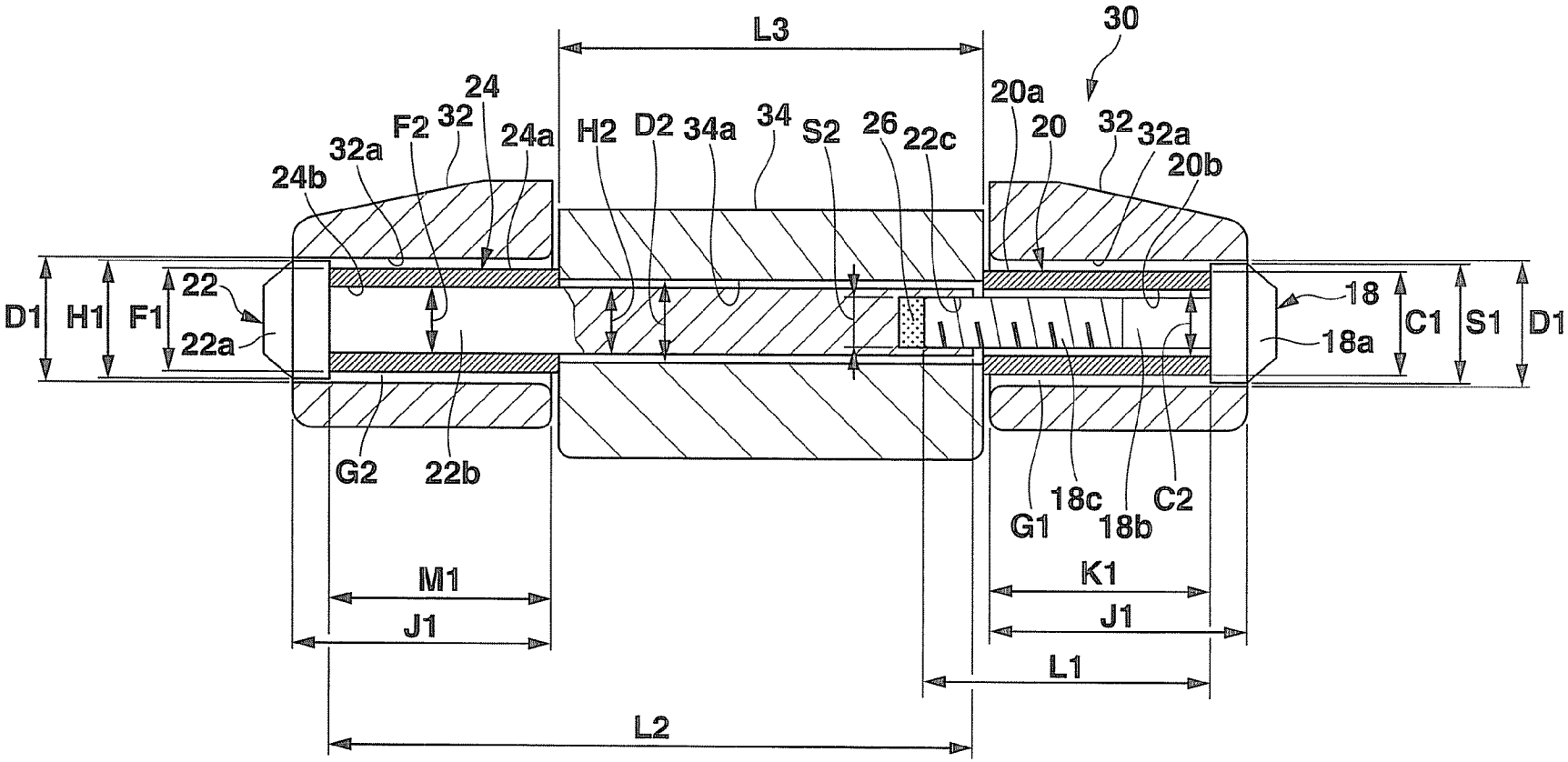
FIG. 7 is a schematically sectional view of the watchband attaching structure according to the third embodiment taken along a line VII-VII in FIG. 5.

FIG. 7 shows that the shaft 18*b* of the first screw member 18, on which the first tubular member 20 is fit, and the shaft 22*b* of the second screw member 22, on which the second tubular member 24 is fit, are inserted into the first through-holes 32*a* of the two projections 32 on the outer circumferential surface of the wristwatch case 10*c*, and then, in the second through-hole 34*a* in the intermediate part 34 on the case-side end part of the watchband 14, the male threads 18*c* on the distal end part of the shaft 18*b* of the first screw member 18 are screwed into the female threads 22*c* in the distal end part of the shaft 22*b* of the second screw member 22, and finally the male threads 18*c* on the distal end part of the shaft 18*b* of the first screw member 18 are fixed with the female threads 22*c* in the distal end part of the shaft 22*b* of the second screw member 22 by the adhesive 26. In this state, the heads 18*a* and 22*a* of the first and second screw members 18 and 22 are partially projected out from outsides of the first through-holes 32*a* of the two projections 32, the outsides being located opposite to the intermediate part 34. However, the whole of each of the heads 18*a* and 22*a* of the first and second screw members 18 and 22 may be placed inward from each of the outsides of the first through-holes 32*a* of the two projections 32.

Also, in this embodiment, similar to the first embodiment as shown in FIG. 3, as shown in FIG. 7, the first and second screw members 18 and 22, which are inserted into the first through-holes 32*a* of the two projections 32 on the outer circumferential surface of the wristwatch case 10*c* and the second through-hole 34*a* of the intermediate part 34 on the case-side end part 14*a* of the watchband 14, are screwed with and fixed with each other at their distal end parts, as described above. And, the first and second tubular members 20 and 24 on the shafts 18*b* and 22*b* of the first and second screw members 18 and 22 are pressed by the heads 18*a* and 22*a* of the first and second screw members 18 and 22, and are made in contact with the outside surfaces of the intermediate part 34. In this state, the first and second screw members 18 and 22 are so positioned that each of outer circumferential surfaces of their heads 18*a* and 22*a* partially or wholly contacts the inner circumferential surface of the first through-hole 32*a* of the projection 32, by the first and second tubular members 20 and 24.

Therefore, this embodiment can enjoy the same technical advantages as those enjoyed by the first embodiment described above with reference to FIGS. 1 to 3.

That is, while the intermediate part 34 on the case-side end part 14*a* of the watchband 14 rocks on the shafts 18*b* and 22*b* of the first and second screw members 18 and 22 to the projections 32 on the outer circumferential surface of the wristwatch case 10*c*, a large friction force is not generated between the outer circumferential surface of the head 18*a* of the first screw member 18 and the inner circumferential surface of the first through-hole 32*a* of the one projection 32 corresponding thereto, and also a large friction force is not generated between the outer circumferential surface of the head 22*a* of the second screw member 22 and the inner circumferential surface of the first through-hole 32*a* of the other projection 32 corresponding thereto. As a result, the screw connection between the distal end parts of the first and second screw members 18 and 22 will not loosen by the above described rocking, further the adhesive 26 fixing the distal end parts to each other surely prevent the loose of the screw connection.

Fourth Embodiment

Next, a wristwatch 10' provided with a fourth embodiment of the watchband attaching structure according to the present invention, and a watchband attaching structure 30' of the fourth embodiment will be explained with reference to FIG. 8.

The most component members of the watchband attaching structure 30' of the fourth embodiment are the same as those of the watchband attaching structure 30 of the third embodiment explained with reference to FIGS. 5 to 7. Therefore, the component members of the watchband attaching structure 30' of the fourth embodiment which are the same as those of the watchband attaching structure 30 of the third embodiment are denoted by the same reference numerals as those denoting the same component members of the watchband attaching structure 30 of the third embodiment corresponding thereto, and detailed explanations thereof are omitted.

The watchband attaching structure 30' of the fourth embodiment is different from the watchband attaching structure 30 of the third embodiment in the diameter C'1 of the outer circumferential surface 20'*a* of the first tubular member 20', and in the diameter F'1 of the outer circumferential surface 24'*a* of the second tubular member 24'.

The diameter C'1 of the outer circumferential surface 20'*a* of the first tubular member 20' and the diameter F'1 of the outer circumferential surface 24'*a* of the second tubular member 24' in the fourth embodiment are the same as the diameter C'1 of the outer circumferential surface 20'*a* of the first tubular member 20' and the diameter F'1 of the outer circumferential surface 24'*a* of the second tubular member 24' in the second embodiment described before with reference to FIG. 4.

That is, the diameter C'1 of the outer circumferential surface 20'*a* of the first tubular member 20' of the fourth embodiment is larger than the outer diameter S1 of the head 18*a* of the first screw member 18, and is smaller than the diameter D1 of the first through-hole 32*a* of the one projection 32 corresponding to the first tubular member 20'. The diameter F'1 of the outer circumferential surface 24'*a* of the second tubular member 24' of the fourth embodiment is larger than the outer diameter H1 of the head 22*a* of the second screw member 22, and is smaller than the diameter D1 of the first through-hole 32*a* of the other projection 32 corresponding to the second tubular member 24'.

Figure 5:
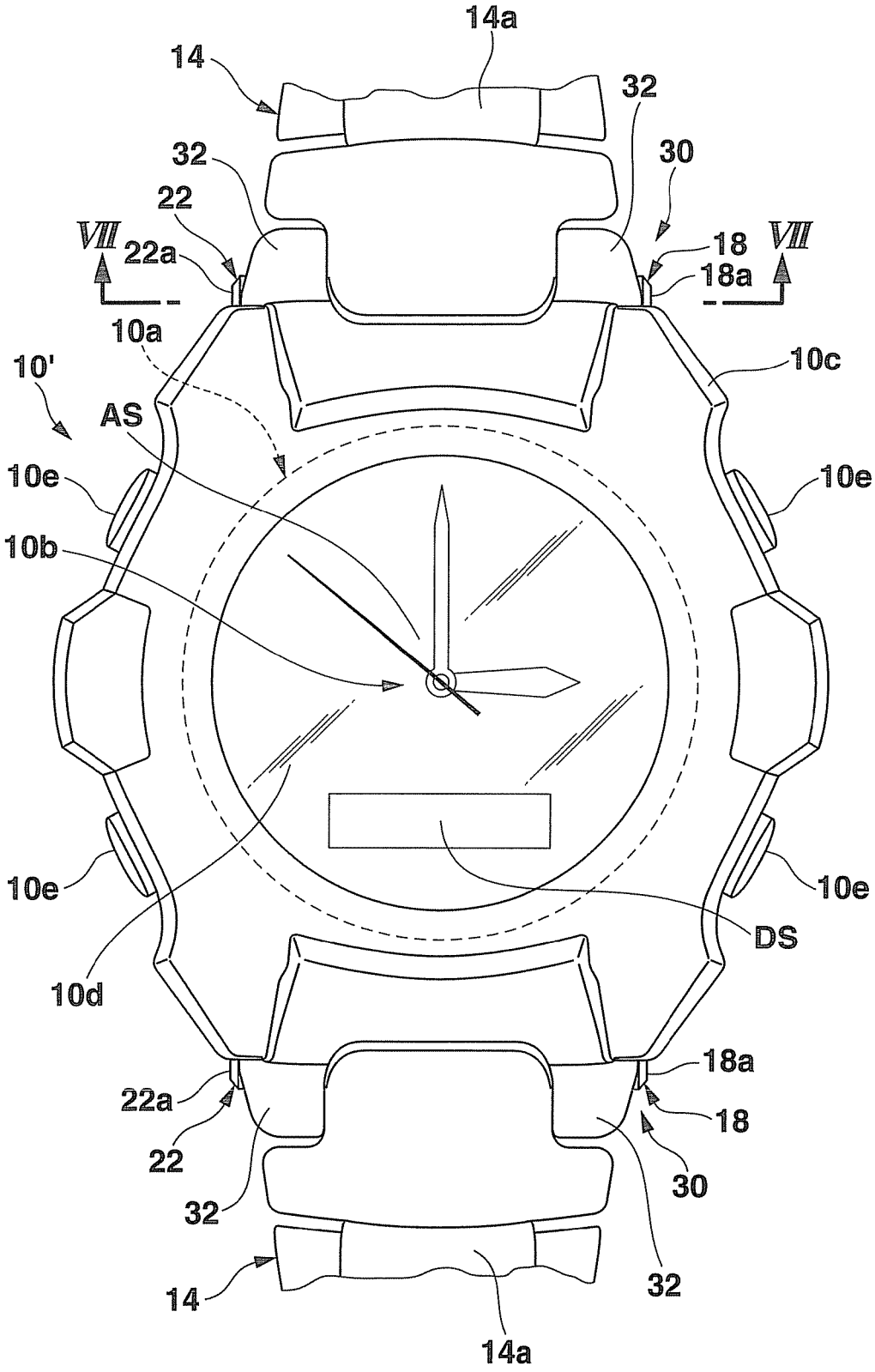
FIG. 5 is an enlarged plan view schematically showing an essential part of a wristwatch having a third embodiment of the watchband attaching structure according to the present invention.
Figure 6:
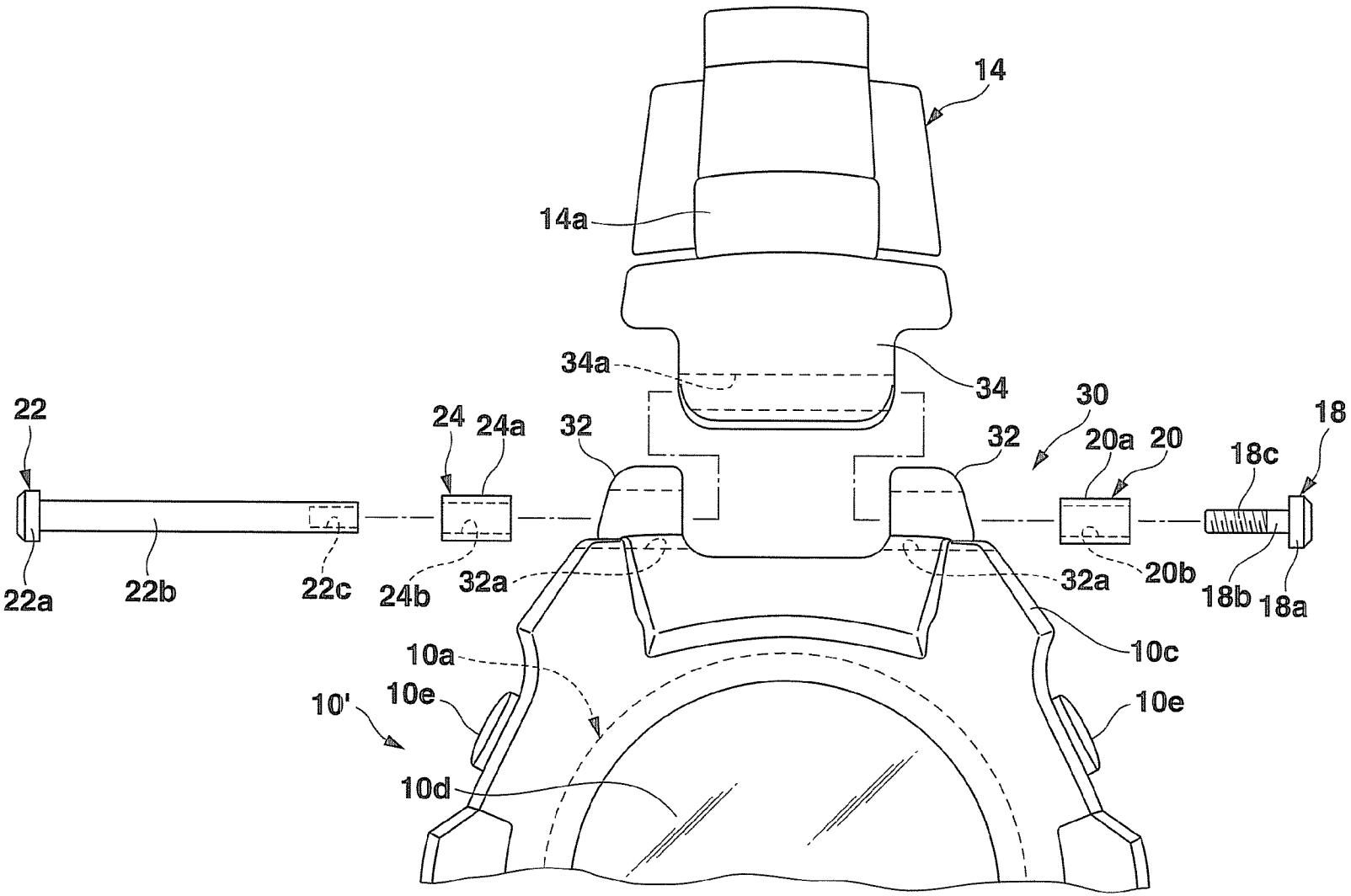
FIG. 6 is a schematically exploded plan view of the watchband attaching structure according to the third embodiment shown in FIG. 5.
Figure 8:
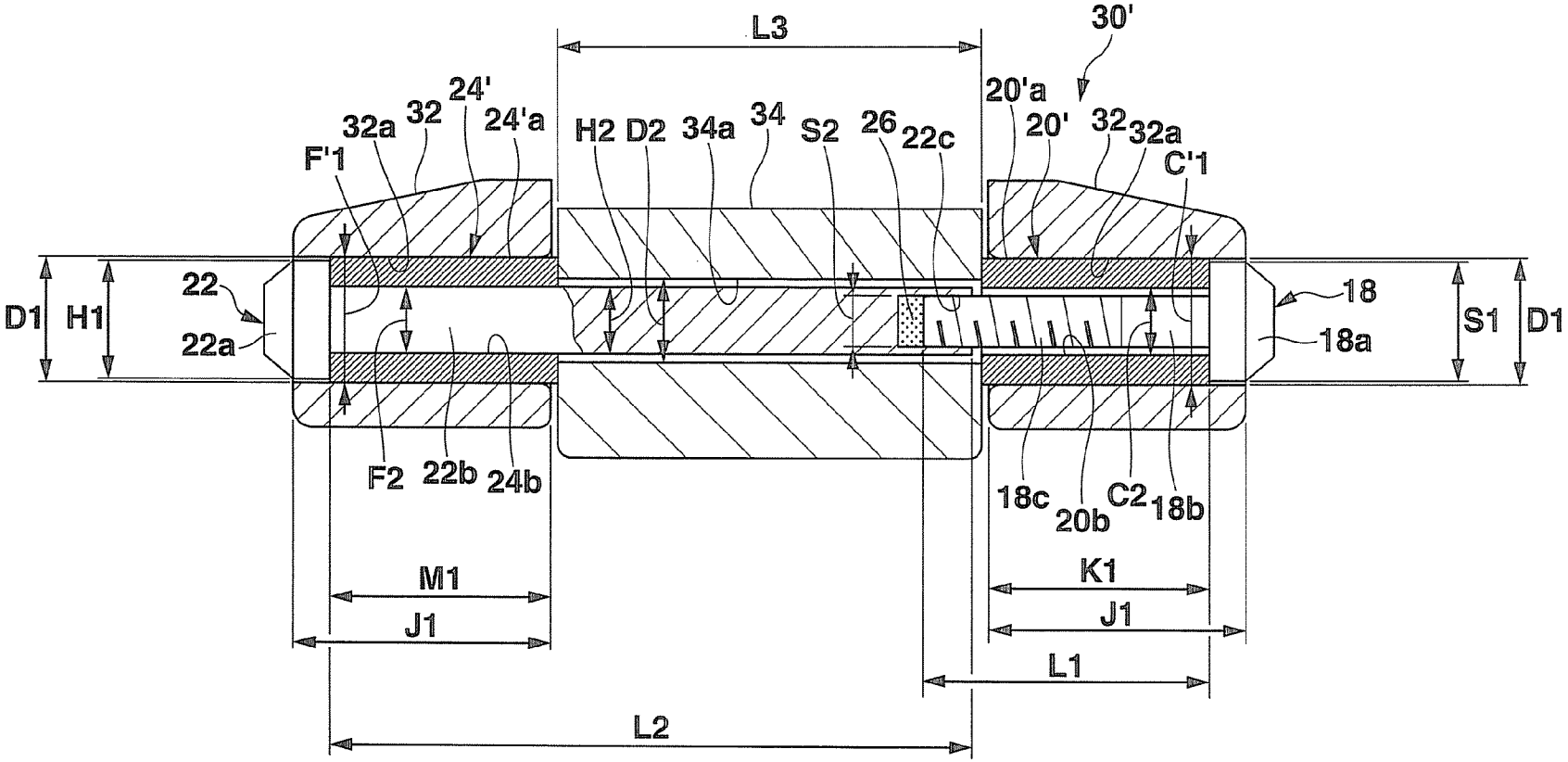
FIG. 8 is a schematically sectional view of a wristwatch having a fourth embodiment of the watchband attaching structure according to the present invention, and is similar to FIG. 7.

In this embodiment, as shown in FIG. 8, while the first and second screw members 18 and 22 are inserted into the first through-holes 32*a* of the paired projections 32 on the outer circumferential surface of the wristwatch case 10*c* shown in FIGS. 5 and 6 and the second through-hole 34*a* of the intermediate part 34 on the case-side end part 14*a* of the watchband 14 shown in FIGS. 5 and 6, the distal end parts of the first and second screw members 18 and 22 are screwed with and fixed with each other in the second through-hole 34*a* of the intermediate part 34 on the case-side end part 14*a* of the watchband 14, as described hereinbefore. In this state, the first and second tubular members 20' and 24', which are supported on the shafts 18*b* and 22*b* of the first and second screw members 18 and 22 and which are made in contact with the both outside surfaces of the intermediate part 34 by the heads 18*a* and 22*a* of the first and second screw members 18 and 22 in the first through-holes 32*a* of the paired projections 32, make their outer circumferential surfaces 20'*a* and 24'*a* be in contact with the inner circumferential surfaces of the first through-holes 32*a* of the projections 32 corresponding thereto and prevent the outer circumferential surfaces of the heads 18*a* and 22*a* from being in contact with the inner circumferential surfaces of the first through-holes 32*a* of the projections 32 corresponding thereto.

The first tubular member 20' is freely rotational on the shaft 18*b* of the first screw member 18 without generating a large frictional force on at least one of the inner circumferential surface of the first through-hole 32*a* of the one projection 32 corresponding thereto and the outer circumferential surface of the shaft 18*b* of the first screw member 18. The second tubular member 24' is freely rotational on the shaft 22*b* of the second screw member 22 without generating a large frictional force on at least one of the inner circumferential surface of the first through-hole 32*a* of the other projection 32 corresponding thereto and the outer circumferential surface of the shaft 22*b* of the second screw member 22.

Therefore, even if the intermediate part 34 on the case-side end part 14*a* of the watchband 14 shown in FIGS. 5 and 6 rocks on the shafts 18*b* and 22*b* of the first and second screw members 18 and 22 with respect to the projections 32 on the outer circumferential surface of the wristwatch case 10*c* shown in FIGS. 5 and 6, a large frictional force is not generated between the outer circumferential surface of the head 18*a* of the first screw member 18 and the inner circumferential surface of the first through-hole 32*a* of the one projection 32 corresponding thereto, and between the outer circumferential surface of the head 22*a* of the second screw member 22 and the inner circumferential surface of the first through-hole 32*a* of the other projection 32 corresponding thereto. As a result of this, the screwing between the distal end parts of the first and second screw members 18 and 22 is not loosen by the above rocking, and the adhesive 26 fixing the distal end parts surely prevents the screwing between the distal end parts of the first and second screw members 18 and 22 from loosing.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A watchband attaching structure for attaching a case-side end part of a watchband to a predetermined position on an outer circumferential surface of a wristwatch case, comprising:

a pair of projections which is provided at one of the predetermined position on the outer circumferential surface of the wristwatch case and the case-side end part of the watchband, and each of which includes a first through-hole, the first through-holes of the projections having the same diameter as to each other and arranged coaxially with each other;

an intermediate part which is provided at the other of the predetermined position on the outer circumferential surface of the wristwatch case and the case-side end part of the watchband, which is placed between the projections, and which includes a second through-hole arranged coaxially to the first through-holes of the projections and having a diameter being smaller than the diameter of the first through-hole;

a first screw member which includes a head, a shaft fixed coaxially with the head and having an outer circumferential surface and a distal end part being opposite to the head, and male threads formed on the distal end part of the outer circumferential surface, the head having a diameter being smaller than the diameter of the first through-hole and being larger than the diameter of the second through-hole, and the outer circumferential surface of the shaft having a diameter being smaller than the diameter of the second through-hole;

a first tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the first screw member;

a second screw member which includes a head, a shaft fixed coaxially with the head and having an outer circumferential surface and a distal end part being opposite to the head, and female threads formed in the distal end part of shaft, the head having a diameter being smaller than the diameter of the first through-hole and being larger than the diameter of the second through-hole, and the outer circumferential surface of the shaft having a diameter being smaller than the diameter of the second through-hole; and a second tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the second screw member, wherein the shaft of the first screw member is inserted into the center hole of the first tubular member, and then is inserted into the first through hole of one of the projections from an outside of the first through-hole of the one projection, and finally is inserted into the second through-hole of the intermediate part, the shaft of the second screw member is inserted into the center hole of the second tubular member, and then is inserted into the first through hole of the other projection from an outside of the first through-hole of the other projection, and then is inserted into the second through-hole of the intermediate part, and finally the male threads of the distal end part on the shaft of the first screw member are screwed into the female threads in the distal end part of the second screw member, the first tubular member on the shaft of the first screw member in the first through-hole of the one projection is placed between the head of the first screw member and a side surface of the intermediate member located near to the one projection, and the second tubular member on the shaft of the second screw member in the first through-hole of the other projection is placed between the head of the second screw member and a side surface of the intermediate member located near to the other projection.

2. The watchband attaching structure according to claim 1, wherein the outer diameter of the outer circumferential surface of the first tubular member is smaller than the outer diameter of the head of the first screw member, and the outer diameter of the outer circumferential surface of the second tubular member is smaller than the outer diameter of the head of the second screw member.

3. The watchband attaching structure according to claim 1, wherein the outer diameter of the outer circumferential surface of the first tubular member is larger than the outer diameter of the head of the first screw member, and the outer diameter of the outer circumferential surface of the second tubular member is larger than the outer diameter of the head of the second screw member.

4. The watchband attaching structure according to claim 1, wherein a length of the first tubular member along a center line of the center hole of the first tubular member is shorter than a length of the first through-hole along a center line of the first through-hole of the one projection, and a length of the second tubular member along a center line of the center hole of the second tubular member is shorter than a length of the first through-hole along a center line of the first through-hole of the other projection.

5. The watchband attaching structure according to claim 1, wherein a length of the shaft of the first screw member along a longitudinal center line of the first screw member is shorter than a length of the shaft of the second screw member along a longitudinal center line of the second screw member, and the distal part of the shaft of the second screw member is placed between an end of the second through-hole located near to the one projection and a center of the second through-hole along the center line of the second through hole, in the second through hole of the intermediate member.

6. The watchband attaching structure according to claim 1, wherein an adhesive is applied to the female threads in the distal end part of the shaft of the second screw member, and the male threads on the distal end part of the shaft of the first screw member screwed into the female threads in the distal end part of the shaft of the second screw member are fixed to the female threads by the adhesive.

7. The watchband attaching structure according to claim 1, wherein the paired projections are provided at the predetermined position on the outer circumferential surface of the wristwatch case, and the intermediate part is provided on the case-side end part of the watchband close to the wristwatch case.

8. The watchband attaching structure according to claim 1, wherein the intermediate part is provided at the predetermined position on the outer circumferential surface of the wristwatch case, and the paired projections are provided on the case-side end part of the watchband.

9. A wristwatch comprising:

a wristwatch case which includes an outer circumferential surface and which contains a time measuring unit configured to measure a time, and a time display unit configured to display the time measured by the time measuring unit;

a watchband which has a case-side end part located near to the wristwatch case; and a watchband attaching structure which is configured to attach the case-side end part of the watchband to a predetermined position on the outer circumferential surface of the wristwatch case, the watchband attaching structure comprising:

a pair of projections which is provided at one of the predetermined position on the outer circumferential surface of the wristwatch case and the case-side end part of the watchband, and each of which includes a first through-hole, the first through-holes of the projections having the same diameter as to each other and arranged coaxially with each other;

an intermediate part which is provided at the other of the predetermined position on the outer circumferential surface of the wristwatch case and the case-side end part of the watchband, which is placed between the projections, and which includes a second through-hole arranged coaxially to the first through-holes of the projections and having a diameter being smaller than the diameter of the first through-hole;

a first screw member which includes a head, a shaft fixed coaxially with the head and having an outer circumferential surface and a distal end part being opposite to the head, and male threads formed on the distal end part of the outer circumferential surface, the head having a diameter being smaller than the diameter of the first through-hole and being larger than the diameter of the second through-hole, and the outer circumferential surface of the shaft having a diameter being smaller than the diameter of the second through-hole;

a first tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the first screw member;

a second screw member which includes a head, a shaft fixed coaxially with the head and having an outer circumferential surface and a distal end part being opposite to the head, and female threads formed in the distal end part of shaft, the head having a diameter being smaller than the diameter of the first through-hole and being larger than the diameter of the second through-hole, and the outer circumferential surface of the shaft having a diameter being smaller than the diameter of the second through-hole; and a second tubular member which includes an outer circumferential surface and an inner circumferential surface defining a center hole, the outer circumferential surface having an outer diameter being smaller than the diameter of the first through-hole and being larger than the diameter of the second through-hole, and the inner circumferential surface having an inner diameter being larger than the diameter of the shaft of the second screw member, wherein the shaft of the first screw member is inserted into the center hole of the first tubular member, and then is inserted into the first through hole of one of the projections from an outside of the first through-hole of the one projection, and finally is inserted into the second through-hole of the intermediate part, the shaft of the second screw member is inserted into the center hole of the second tubular member, and then is inserted into the first through hole of the other projection from an outside of the first through-hole of the other projection, and then is inserted into the second through-hole of the intermediate part, and finally the male threads of the distal end part on the shaft of the first screw member are screwed into the female threads in the distal end part of the second screw member, the first tubular member on the shaft of the first screw member in the first through-hole of the one projection is placed between the head of the first screw member and a side surface of the intermediate member located near to the one projection, and the second tubular member on the shaft of the second screw member in the first through-hole of the other projection is placed between the head of the second screw member and a side surface of the intermediate member located near to the other projection.

10. The wristwatch according to claim 9, wherein, in the band attaching structure, the outer diameter of the outer circumferential surface of the first tubular member is smaller than the outer diameter of the head of the first screw member, and the outer diameter of the outer circumferential surface of the second tubular member is smaller than the outer diameter of the head of the second screw member.

11. The wristwatch according to claim 9, wherein, in the band attaching structure, the outer diameter of the outer circumferential surface of the first tubular member is larger than the outer diameter of the head of the first screw member, and the outer diameter of the outer circumferential surface of the second tubular member is larger than the outer diameter of the head of the second screw member.

12. The wristwatch according to claim 9, wherein, in the band attaching structure, a length of the first tubular member along a center line of the center hole of the first tubular member is shorter than a length of the first through-hole along a center line of the first through-hole of the one projection, and a length of the second tubular member along a center line of the center hole of the second tubular member is shorter than a length of the first through-hole along a center line of the first through-hole of the other projection.

13. The wristwatch according to claim 9, wherein, in the band attaching structure, a length of the shaft of the first screw member along a longitudinal center line of the first screw member is shorter than a length of the shaft of the second screw member along a longitudinal center line of the second screw member, and the distal part of the shaft of the second screw member is placed between an end of the second through-hole located near to the one projection and a center of the second through-hole along the center line of the second through hole, in the second through hole of the intermediate member.

14. The wristwatch according to claim 9, wherein, in the band attaching structure, an adhesive is applied to the female threads in the distal end part of the shaft of the second screw member, and the male threads on the distal end part of the shaft of the first screw member screwed into the female threads in the distal end part of the shaft of the second screw member are fixed to the female threads by the adhesive.

15. The wristwatch according to claim 9, wherein, in the band attaching structure, the paired projections are provided at the predetermined position on the outer circumferential surface of the wristwatch case, and the intermediate part is provided on the case-side end part of the watchband close to the wristwatch case.

16. The wristwatch according to claim 9, wherein, in the band attaching structure, the intermediate part is provided at the predetermined position on the outer circumferential surface of the wristwatch case, and the paired projections are provided on the case-side end part of the watchband.

* * * * *